US007726774B2

(12) United States Patent
Samoto et al.

(10) Patent No.: US 7,726,774 B2
(45) Date of Patent: Jun. 1, 2010

(54) IMAGE FORMING DEVICE CAPABLE OF STABLY SUPPORTING CARRIAGE

(75) Inventors: Kenji Samoto, Nagoya (JP); Noriyuki Kawamata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 648 days.

(21) Appl. No.: 11/615,527

(22) Filed: Dec. 22, 2006

(65) Prior Publication Data

US 2007/0165066 A1 Jul. 19, 2007

(30) Foreign Application Priority Data

Dec. 28, 2005 (JP) ..... 2005-377524

(51) Int. Cl.
*B41J 23/00* (2006.01)

(52) U.S. Cl. ..... 347/37

(58) Field of Classification Search ..... 347/37, 347/20

See application file for complete search history.

(56) References Cited

U.S. PATENT DOCUMENTS

| | | | | |
|---|---|---|---|---|
| 4,883,445 | A | 11/1989 | Gomoll et al. | |
| 6,789,966 | B2 | 9/2004 | Tanaka et al. | |
| 2003/0076389 | A1 * | 4/2003 | Shimizu | 347/85 |
| 2004/0061739 | A1 * | 4/2004 | Lewis et al. | 347/37 |
| 2005/0195242 | A1 | 9/2005 | Samoto et al. | |
| 2005/0243125 | A1 | 11/2005 | Ishikawa | |
| 2007/0146419 | A1 | 6/2007 | Samoto et al. | |
| 2007/0146421 | A1 | 6/2007 | Samoto et al. | |

FOREIGN PATENT DOCUMENTS

| | | | |
|---|---|---|---|
| CN | 1689828 | A | 11/2005 |
| EP | 0311731 | B1 | 4/1991 |
| EP | 1591260 | A2 | 11/2005 |
| JP | H5270091 | | 10/1993 |
| JP | 2002254746 | | 9/2002 |
| JP | 2005246907 | | 9/2005 |
| JP | 2005313492 | | 11/2005 |

OTHER PUBLICATIONS

European Patent Office, European Search Report for Related EP Application No. 06026339 dated Mar. 21, 2007.
Chinese Patent Office, Notification of First Office Action for Chinese Patent Application No. 200610156715.1 (counterpart to above-captioned patent application), issued Oct. 31, 2008.

* cited by examiner

*Primary Examiner*—Julian D Huffman
*Assistant Examiner*—Jason S Uhlenhake
(74) *Attorney, Agent, or Firm*—Baker Botts L.L.P.

(57) ABSTRACT

A downward component force of a tensile force exerted on a timing belt at a belt coupling part and the weight of a carriage act upon a first sliding surface of a first guide member and a second sliding surface of a second guide member via a first sliding protrusion and second sliding protrusions. Since the center of gravity of the carriage is located between the first sliding protrusion and the second sliding protrusions, the carriage can be stably supported by the first and second guide members while the carriage remains stationary or moves at a constant speed in a main scanning direction.

8 Claims, 15 Drawing Sheets

IMAGE FORMING DEVICE CAPABLE OF STABLY SUPPORTING CARRIAGE

CROSS REFERENCE TO RELATED APPLICATION

This application claims priority from Japanese Patent Application No. 2005-377524 filed Dec. 28, 2005. The entire content of this priority application is incorporated herein by reference.

TECHNICAL FIELD

The disclosure relates to an image forming device having a configuration for supporting a carriage that mounts a recording head.

BACKGROUND

In a conventional image forming device, as disclosed in Japanese Patent Application-Publication No. HEI-5-270091, a carriage with a recording head mounted thereon is generally supported slidably by a cylindrical guide shaft so that the carriage can reciprocate in a main scanning direction.

Since the carriage supported by the cylindrical guide shaft has excellent dimensional accuracy and high rigidity, fluctuation in a so-called paper gap between a nozzle surface of the recording head and a recording medium can be reduced, and thus a high-quality recorded image is easily obtained. However, a frame structure as well as the cylindrical guide shaft are expensive. Also, in order to detach the carriage from the guide shaft for maintenance and replacement operations, it is necessary to first detach the guide shaft from the frame, and then the carriage is detached from the guide shaft. In order to attach the carriage to the guide shaft, the reverse procedure must be performed, thereby posing considerable difficulty in attachment and detachment of the carriage.

U.S. Pat. No. 6,789,966 and US2005/0243125 disclose printers having following structures. That is, a plate-like first guide member is disposed on an upstream side of a plate-like second guide member with respect to a sheet feeding direction, with a board-like platen interposed therebetween. Both the first and second guide members extend in a main scanning direction perpendicular to the sheet feeding direction. A recording head is provided on the lower surface of a carriage that is slidably supported by the first and second guide members. The carriage is connected to a part of an endless belt extending in the main scanning direction and driven by a carriage driving motor to reciprocate.

Guide parts (sliding protrusions) which contact (slide over) the upper surfaces as sliding surfaces of the first and second guide members are provided on the lower surface of the carriage, thereby controlling a printing gap (paper gap) between the recording head on the carriage and a sheet on the platen. A carriage guide plate is formed at the second guide member (guide member that is closer to a place coupled to the endless belt), by means of cutting and pulling up the cut portion. In this manner, the carriage is controlled not to rotate around a vertical axis when the carriage moves by being pulled by the endless belt.

In U.S. Pat. No. 6,789,966, the carriage mounts an ink cartridge thereon. On the other hand, in US2005/0243125, an ink cartridge is placed to be stationary in a main housing of a printer, and the ink cartridge is coupled to the carriage through an ink supply tube.

In the printer disclosed in US2005/0243125, a driving pulley is fixedly attached to a carriage motor (CR motor) fixed at one end of a frame of the main housing or the second guide member in the main scanning direction, and a driven pulley is freely rotatably attached to the other end thereof in the main scanning direction. Flange parts are formed to the driving pulley and the driven pulley so that the endless belt wound thereon does not get off in the axis direction of the pulleys. The position of a part of the endless belt that is attached to the carriage is set higher in the vertical direction than the positions where the endless belt is wound around the pulleys, so that the carriage is pressed against the upper surface of the second guide member due to a downward component force of a tensile force exerted on the endless belt. In other words, it is possible to eliminate unstability, for example, the possibility that the carriage floats up from the second guide member when the carriage is pulled by the endless belt.

With the configuration disclosed by U.S. Pat. No. 6,789,966 and US2005/0243125, the part of the endless belt that is coupled to the carriage is located above the guide part of the carriage which contacts the upper horizontal sliding surface of the second guide member or downstream of the guide part that is on the downstream side of the first guide member. Thus, when the downward component force of the tensile force exerted on the endless belt is applied at a belt-coupling position of the carriage where the carriage is coupled to the endless belt, the guide parts of the carriage float up from the sliding surface of the first guide member on the side further from the belt-coupling position. That is, the carriage is subjected to a moment for rotating around an axis parallel to the main scanning direction. Accordingly, the orientation of the carriage during an image forming operations becomes unstable, and thus the accuracy of the paper gap also becomes degraded. As a result, quality of a recorded image is deteriorated or becomes unstable.

SUMMARY

The invention provides an image forming device including a recording head having a nozzle surface, a carriage that mounts the recording head and is reciprocatable in a first direction, a first guide member having a first sliding surface extending in a horizontal direction, a second guide member having a second sliding surface extending in the horizontal direction, and an endless belt that extends in the first direction above the second guide member and is movable in the first direction. The second guide member is disposed on a downstream side of the first guide member with respect to a second direction orthogonal to the first direction. The first sliding surface and the second sliding surface slidably support the carriage and extend parallel to the nozzle surface. The carriage is provided with a first protruding member that contacts the first sliding surface and a second protruding member that contacts the second sliding surface. Both the first protruding member and the second protruding member protrude downward from a bottom side of the carriage. The carriage and the endless belt are coupled to each other at a coupling point located between the first protruding member and the second protruding member with respect to the second direction.

BRIEF DESCRIPTION OF THE DRAWINGS

Illustrative aspects in accordance with the invention will be described in detail with reference to the following figures wherein.

DETAILED DESCRIPTION

Figure 1:
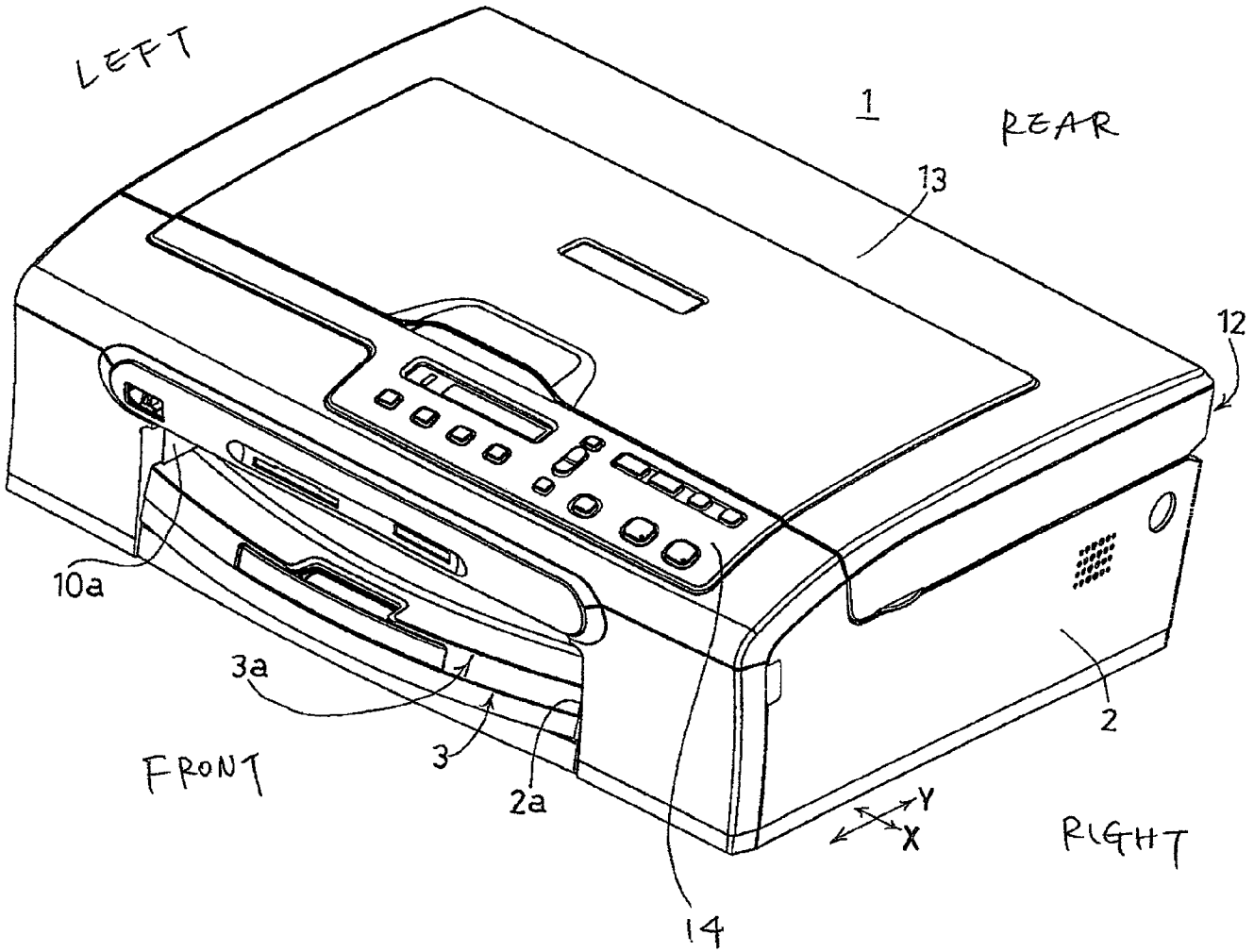
FIG. 1 is a perspective view of an image forming device according to illustrative aspects of the invention.

An image-forming device 1 according to some aspects of the invention will be described while referring to the accompanying drawings wherein like parts and components are designated by the same reference numerals to avoid duplicating description.

Figure 2:
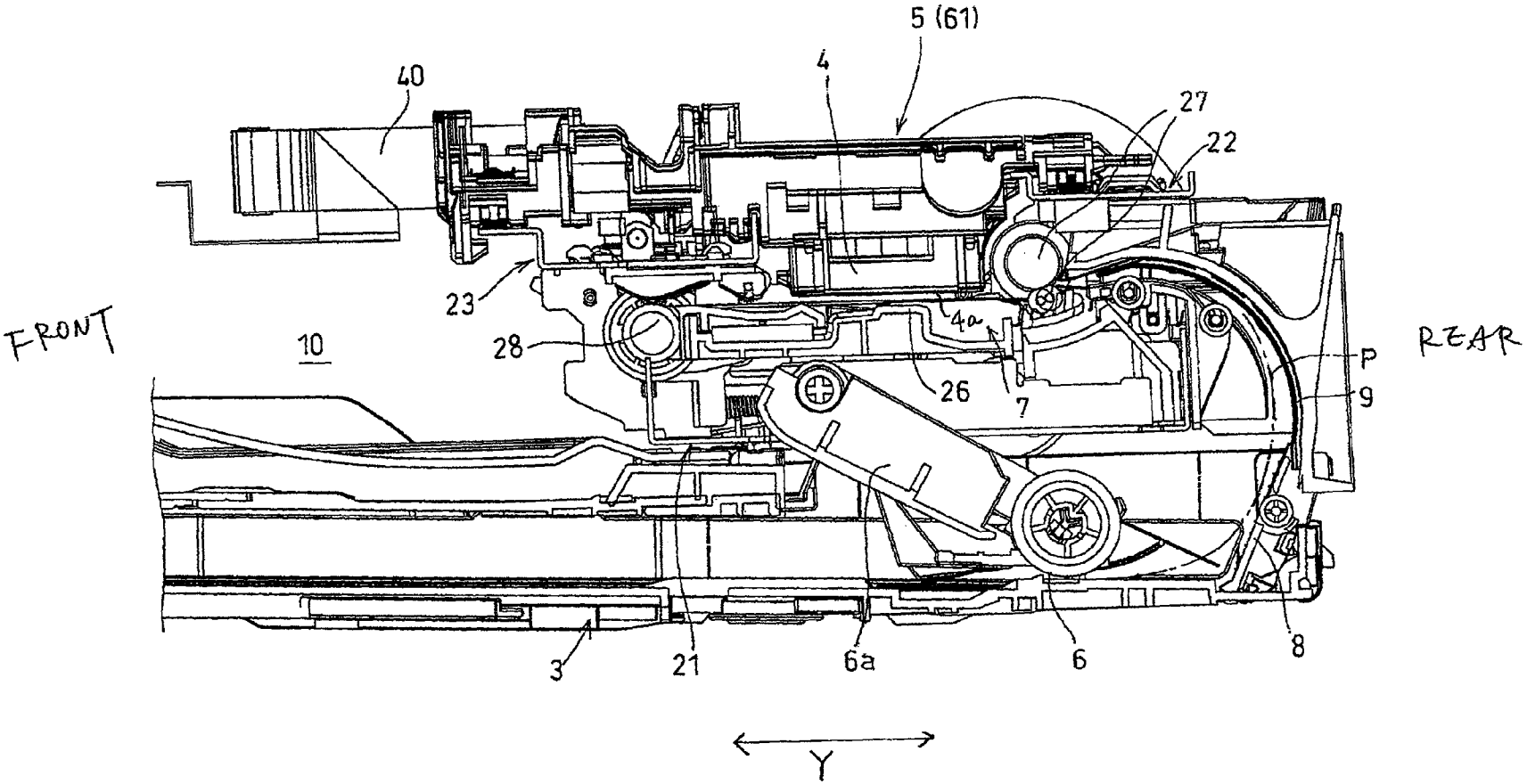
FIG. 2 is a side cross-sectional partial view of a recording unit of the image forming device in FIG. 1.

The image-forming device 1, to which the invention is applied, is a multifunction device (MFD) having a printing function, a copying function, a scanning function, and a facsimile function. As shown in FIGS. 1 and 2, the image-forming device 1 includes a housing 2 made from a synthetic resin. A sheet-feeding cassette 3 is disposed in the bottom section of the housing 2. The sheet-feeding cassette 3 can be pulled out of the housing 2 through a discharge opening 2*a* formed in a side of the housing 2. Note that in the following description, a side on which the discharge opening 2*a* is provided is referred to as a front side of the image-forming device 1, and a side furthest from the discharge opening 2*a* is referred to as a rear side of the image-forming device 1.

The sheet-feeding cassette 3 accommodates a stack of sheets of paper P (FIG. 2) of A4 size, letter size, legal size, postcard size, or the like, such that short sides of the paper P extend in a main scanning direction X (FIG. 1) orthogonal to a sheet feeding direction (subscanning direction Y).

An image reader 12 for reading images on an original in copying and facsimile functions is disposed on top of the housing 2.

An operation panel 14 is disposed on the top of the housing 2 frontward of the image reader 12. The operation panel 14 includes various operation buttons, a liquid crystal display, and the like.

Although not shown in the drawings, a glass plate is disposed on the top surface of the image reader 12. An original can be mounted on the glass plate by pivoting a document cover 13 upward. A contact image sensor is disposed beneath the glass plate for reading images on originals so as to be reciprocatingly movable in the main scanning direction X.

Figure 3:
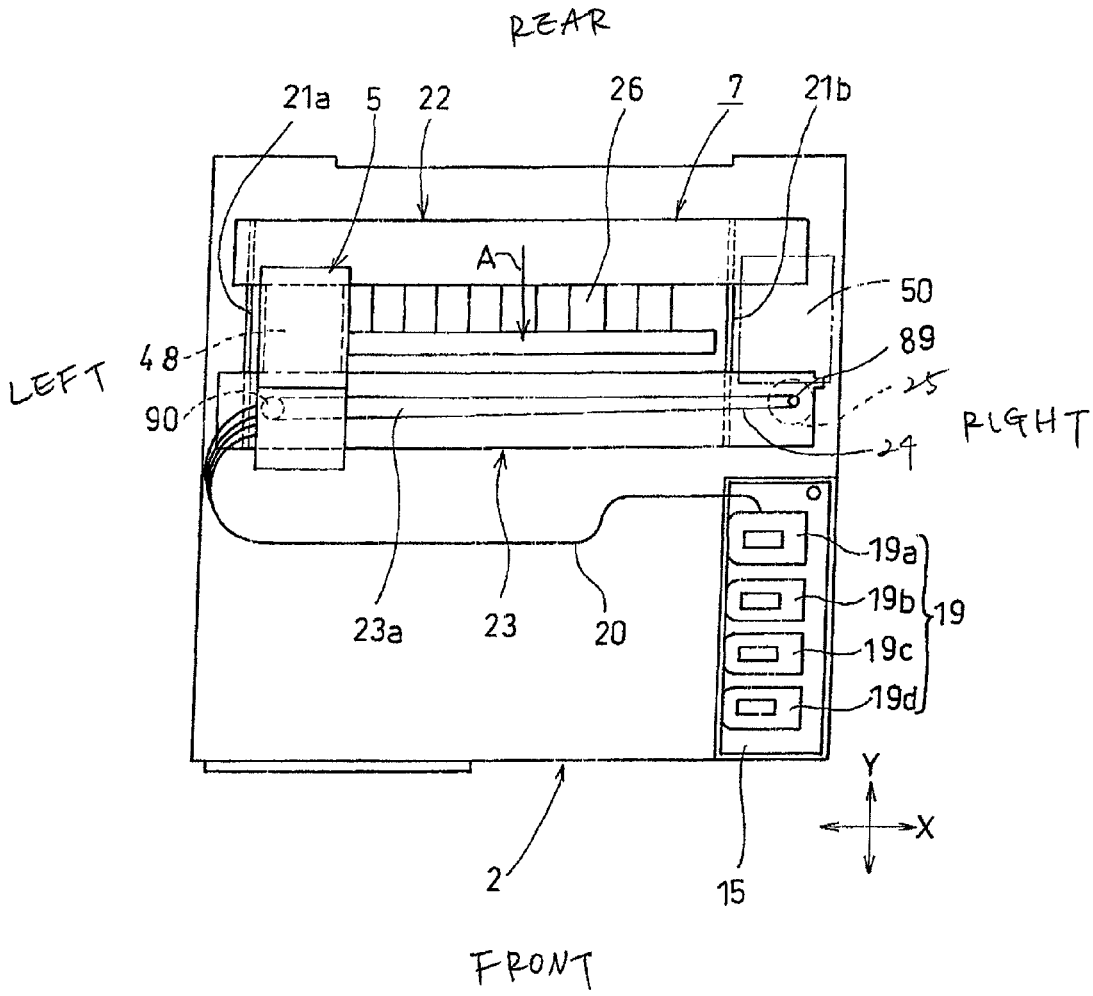
FIG. 3 is a plan view of the image forming device in FIG. 1 with an image reader being removed.

The image-forming device 1 further includes a recoding unit 7 and a sheet discharge section 10 shown in FIG. 2 and an ink storage section 15 shown in FIG. 3 which is disposed on one side of the sheet discharge section 10. The recoding unit 7, the sheet discharge section 10, and the ink storage section 15 are disposed within an area projected by the image reader 12 and the operation panel 14 in a plan view.

The recoding unit 7 includes a recording head 4, a carriage 5, and a platen 26. The recording head 4 is an inkjet-type recording head and is mounted on the carriage 5. The recording head 4 has a nozzle surface 4*a* facing downward. The nozzle surface 4*a* is formed with nozzles through which ink droplets are selectively ejected. The platen 26 is plate shaped for supporting a sheet of paper P at a position below the recording head 4.

As shown in FIG. 3, the ink storage section 15 accommodates ink cartridges 19 (19*a* through 19*d*) for full-color printing in an alignment in the Y-axis direction. The ink storage section 15 is open on the top so that the ink cartridges 19 can be mounted on and dismounted from the ink storage section 15 from the open top side. Each ink cartridge 19 stores ink of one of four colors black (Bk), cyan (C), magenta (M) and yellow (Y). Each of the ink cartridges 19 has a substantially rectangular box-shape with a small cross-sectional area in a plan view and a high height.

The ink stored in the ink cartridges 19 is supplied to the recording head 4 via four ink supply tubes 20 (20*a* to 20*d*). It should be noted that if ink of more than four colors (e.g., six, seven, or eight colors) is used for the full-color printing, then the numbers of the ink cartridges 19 and the ink supply tubes 20 may be increased in proportion to the number of ink colors.

As shown in FIG. 1, an auxiliary cassette 3*a* for supporting and feeding a plurality of small-sized sheets (not shown) is attached to the upper front end of the sheet-feeding cassette 3 so as to be movable in the Y-axis direction. FIG. 1 shows the state where the auxiliary cassette 3*a* is pressed into the housing 2 so as not to protrude from the housing 2.

As shown in FIG. 2, a sloped section 8 to separate the sheets is provided at a rear end of the sheet-feeding cassette 3. Also, an arm 6*a* is disposed on the housing 2. The arm 6*a* is pivotable about a base end so that a distal end moves upward and downward. A sheet feed roller 6 is provided to the distal end of the arm 6*a*. The sloped section 8 and the sheet feed roller 6 together separate and feed the sheets of paper P stacked on the sheet-feeding cassette 3 and the auxiliary sheet-feeding cassette 3*a* one sheet at a time. The separated sheet of paper P is fed to the recording unit 7 provided in the upper rear of the sheet-feeding cassette 3 (at a higher position than the sheet-feeding cassette 3) through a U-turn path 9 which is oriented laterally and upwardly.

The sheet discharge section 10 is formed above the auxiliary cassette 3*a*. The sheet of paper P formed with images thereon by the recording unit 7 is discharged to the sheet discharge section 10 with a recorded surface facing upward. A sheet discharge opening 10*a* (upper section of the opening 2*a*, FIG. 1) connecting to the sheet discharge section 10 is opened to the front surface of the housing 2.

A pair of registration rollers 27 is disposed on the upstream side of the platen 26 in a sheet feeding direction A for conveying the sheet of paper P to a position between the platen 26 and the recording head 4.

A spur (not shown) which contacts the upper surface of the sheet of paper P and a sheet discharge roller 28 which contacts the lower surface of the sheet of paper P are disposed downstream of the platen 26 for discharging the sheet of paper P with images formed thereon to the sheet discharge section 10.

As shown in FIG. 3, an ink receiving portion 48 and a maintenance unit 50 are disposed on the left and right sides of the paper conveying path, respectively. That is, the ink receiving portion 48 and the maintenance unit 50 are disposed outside the width of the sheet of paper P to be conveyed. During printing operation, the recording head 4 regularly performs a flushing operation for ejecting ink in order to prevent the nozzles from being clogged, at a flushing position in confrontation with the ink receiving portion 48. Ink ejected through the flushing operation is received at the ink receiving portion 48. The maintenance unit 50 performs recovering operations when the carriage 5 is at a standby position. For example, the maintenance unit 50 selectively draws ink of each color from the recording head 4 and removes air bubbles contained in a buffer tank (not shown) of the recording head 4. The maintenance unit 50 performs a cleaning operation for wiping the nozzle surface 4*a* of the recording head 4 by a wiper as the carriage 5 moves in the X-axis direction from the position of the maintenance unit 50 toward the image-forming region.

Figure 4:
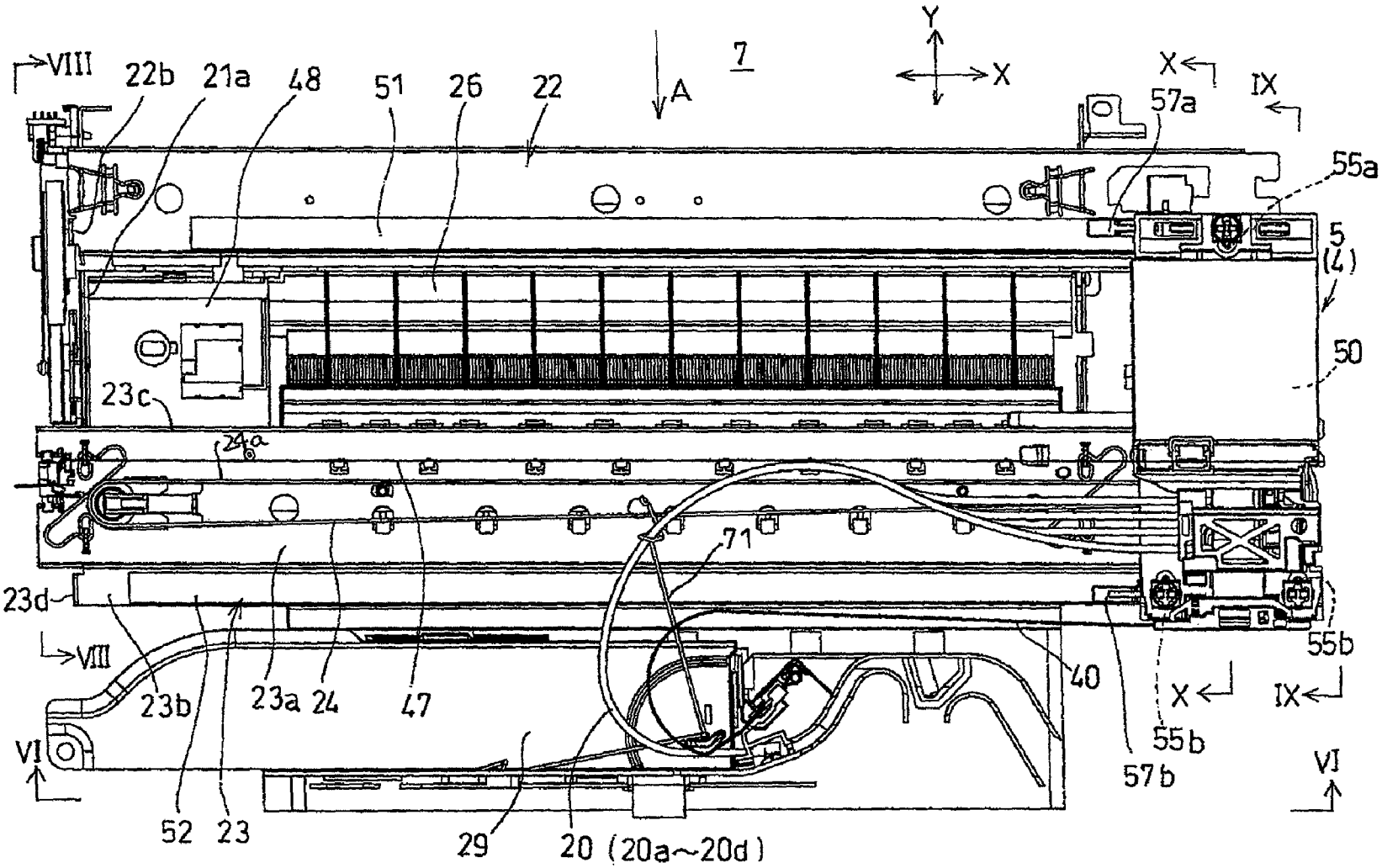
FIG. 4 is a plan view of the recording unit in FIG. 2.

As shown in FIGS. 3 and 4, the recording unit 7 further includes plate-shaped first and second guide members 22 and 23, a timing belt 24, a carriage motor 25, an encoder strip 47, a driving pulley 89, a driven pulley 90, and the like.

The first and second guide members 22 and 23 are supported on a pair of left and right plates 21*a* and 21*b* of an open-top main frame 21 so as to extend in the X-axis direction. The second guide member 23 is disposed on the downstream side of the first guide member 22 in the sheet feeding direction A.

The carriage 5 mounting the recording head 4 is slideably supported on the first and second guide plates 22 and 23 so as to be reciprocally movable in the main scanning direction X (X-axis direction).

The timing belt 24 is an endless belt for reciprocatingly moving the carriage 5, and is wound around the driving pulley 89 and the driven pulley 90 so as to extend in the main scanning direction X above the second guide member 23. The carriage motor 25 is for driving the timing belt 24. According to the illustrative aspects, a DC motor is used as the carriage motor 25, but a stepping motor or other types of motors may be used instead. The encoder strip 47 (FIG. 4) is for detecting a position of the carriage 5 in the main scanning direction X. The encoder strip 47 extends in the main scanning direction X and has a vertically-extending detection surface in which slits are formed at fixed intervals in the main scanning direction X.

Figure 10:
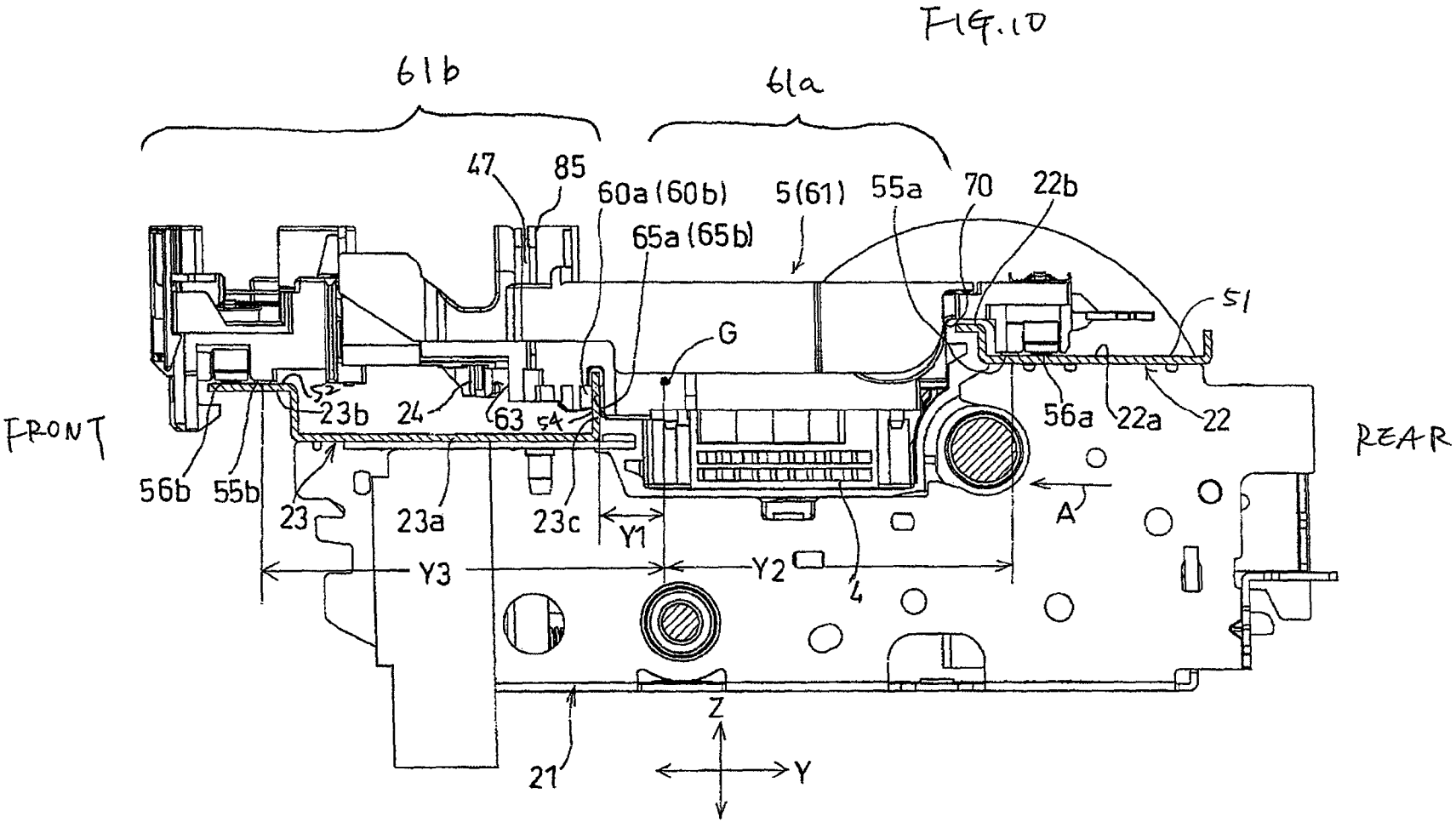
FIG. 10 is an enlarged cross-sectional view of the recording unit taken along a line X-X in FIG. 4.

The first and second guide members 22 and 23 are horizontally disposed. As shown in FIG. 10, the first guide member 22 includes a flat plate 22*a* and a protrusion 22*b* formed integrally with the flat plate 22*a*. The protrusion 22*b* is formed in the shape of a character Z in a side view. The second guide member 23 includes a horizontal wide piece 23*a*, a flat plate 23*b* located in front of the horizontal wide piece 23*a*, and a substantially vertical guide piece 23*c* which is located in the rear of the horizontal wide piece 23*a* and bent upward. The horizontal wide piece 23*a* serves as a reference plane during the attachment of the timing belt 24, the carriage (CR) motor 25, and the encoder strip 47 with respect to the vertical direction Z.

A first sliding surface 51 and a second sliding surface 52 are formed on the upper surfaces of the flat plates 22*a* and 23*b*, respectively. The first and second sliding surfaces 51 and 52 are parallel to the nozzle surface 4*a* of the recording head 4. As will be described later, the first and second sliding surfaces 51 and 52 serve to slidably support, in an horizontal manner, an upstream region and a downstream region, respectively, of the carriage 5 in the sheet feeding direction A.

A vertical third sliding surface 54 is formed on the guide piece 23*c* to face frontward. Each of the first, second, and third sliding surfaces 51, 52, and 54 is linearly formed to extend in the X-axis direction.

Figure 12:
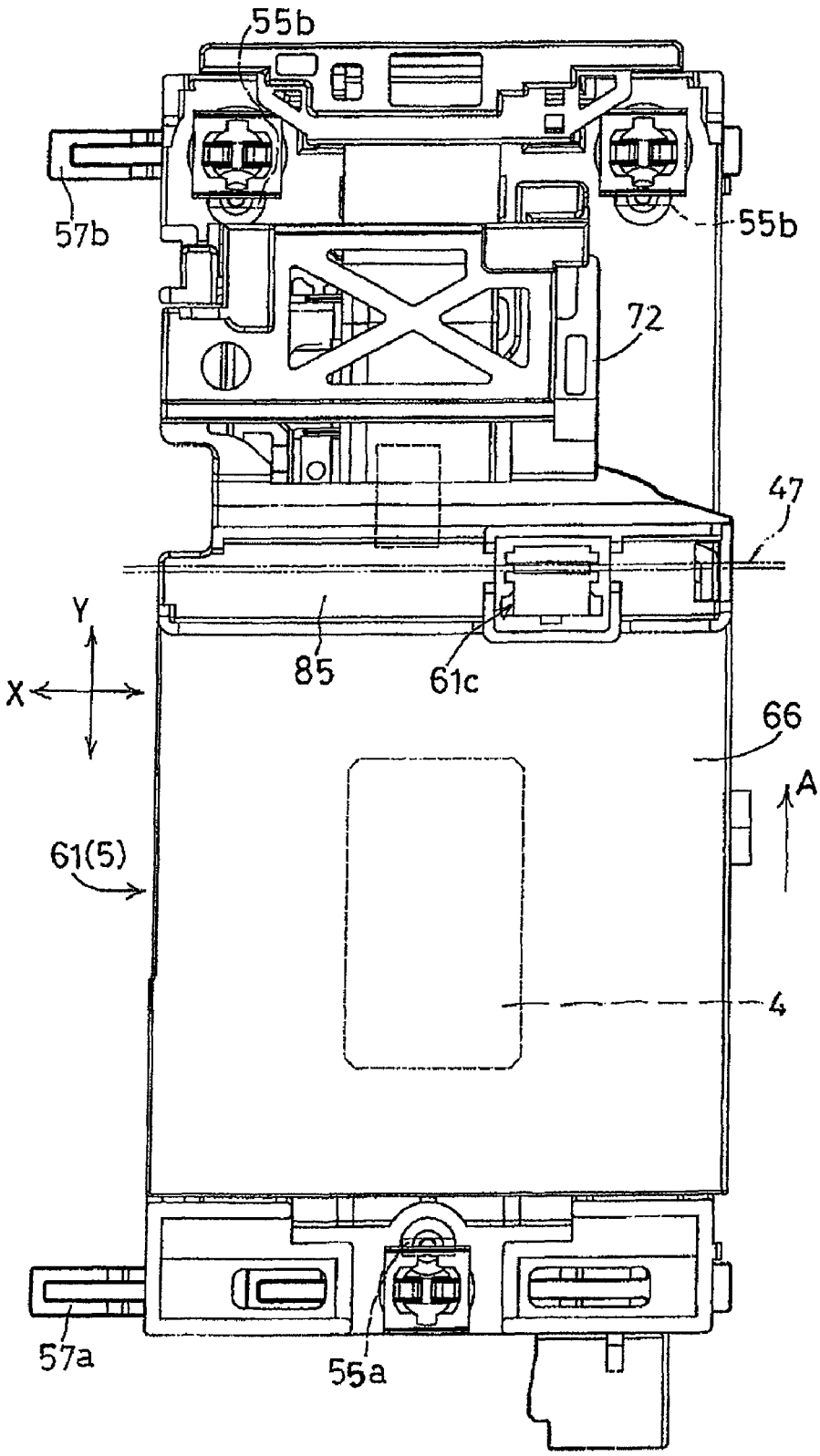
FIG. 12 is a plan view of the carriage.

As shown in FIG. 12, the carriage 5 has a holder 61 made of synthetic resin into substantially a rectangular shape in a plan view. A head storage part 61*a* is formed in the rear section of the holder 61. The head storage part 61*a* is large in height and accommodates the recording head 4 at the lower section thereof.

Figure 11:
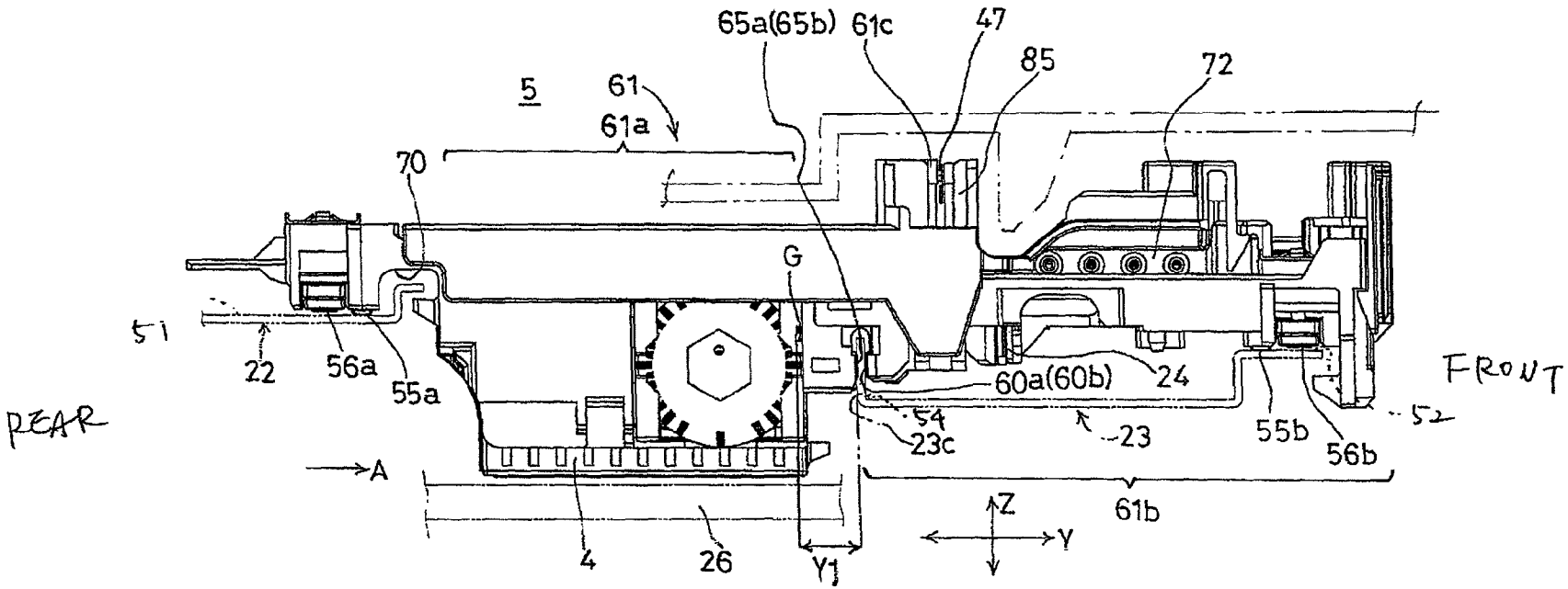
FIG. 11 is a left side view of a carriage of the image forming device in FIG. 1.

As shown in FIG. 11, a connection supporting part 61*b* is integrally formed with the holder 61 at the front portion thereof. A tube connecting unit 72 is formed on one side of the connection supporting part 61*b* in the X-axis direction, and ends of the ink supply tubes 20*a* to 20*d* are connected to the tube connecting unit 72 sideways to form an ink passage (not shown) for supplying ink to the recording head 4. An end of a flexible flat cable 40 is also connected to the connection supporting part 61*b*.

Figure 7:
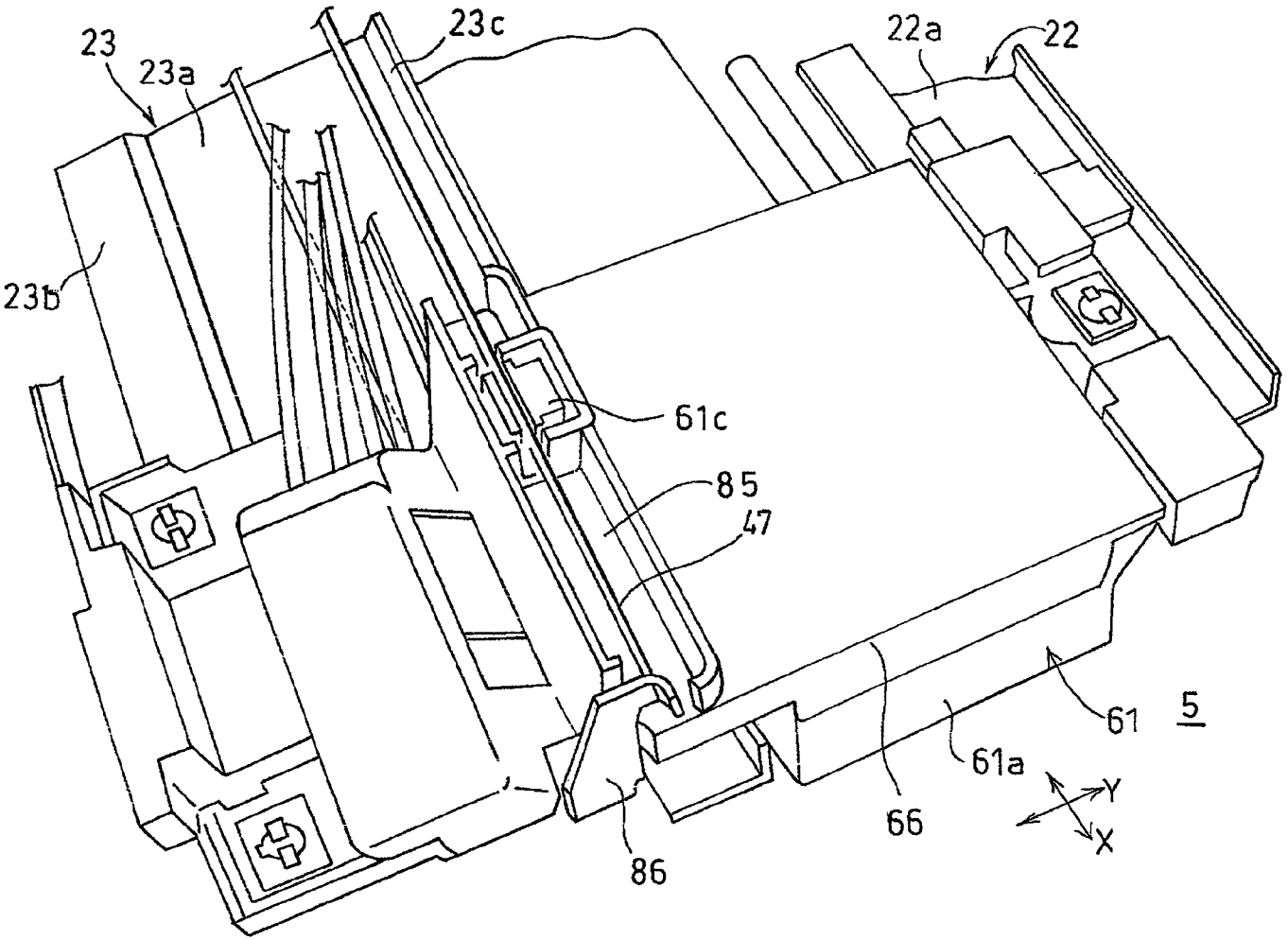
FIG. 7 is an enlarged perspective partial view of the recording unit.

As shown in FIGS. 7 and 12, the upper surface of the connection supporting part 61*b* is covered with a detachable top cover 66 made of synthetic resin. A control board (not shown) for receiving a signal from the flexible flat cable 40 and outputting predetermined drive signals to the recording head 4 is disposed between the top cover 66 and the connection supporting part 61*b*. The top cover 66 needs to be detachable for maintenance, such as replacement of the control board, replacement of the ink supply tubes 20*a* to 20*d*, or the like.

Figure 6:
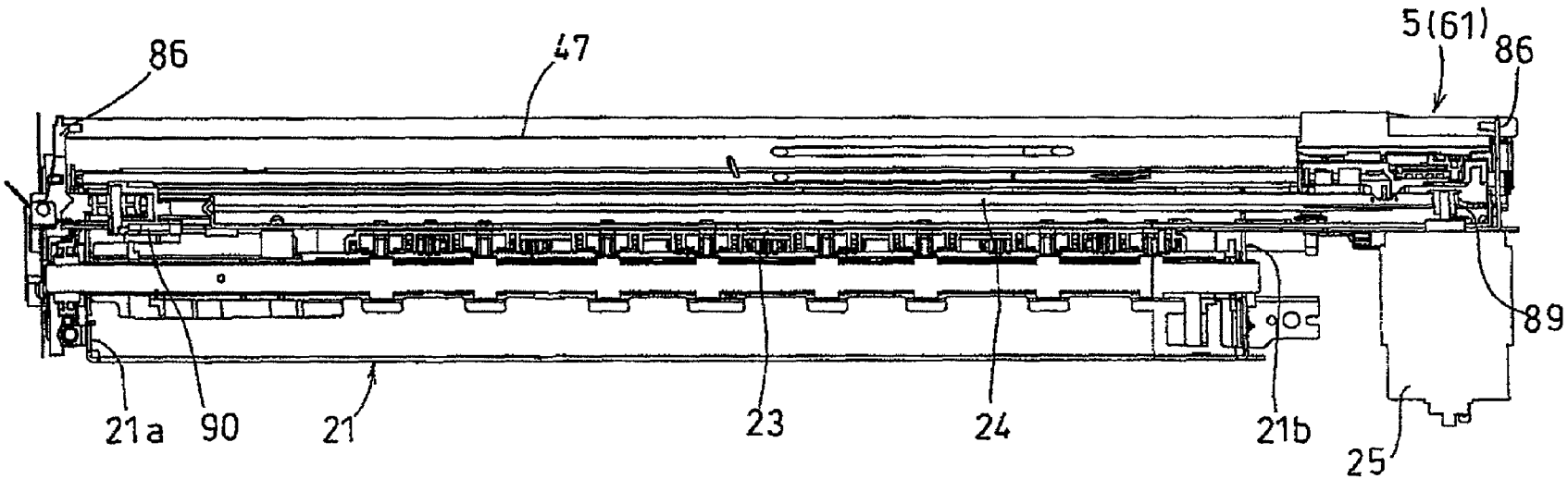
FIG. 6 is a cross-sectional view of the recording unit taken along a line VI-VI in FIG. 4.
Figure 8:
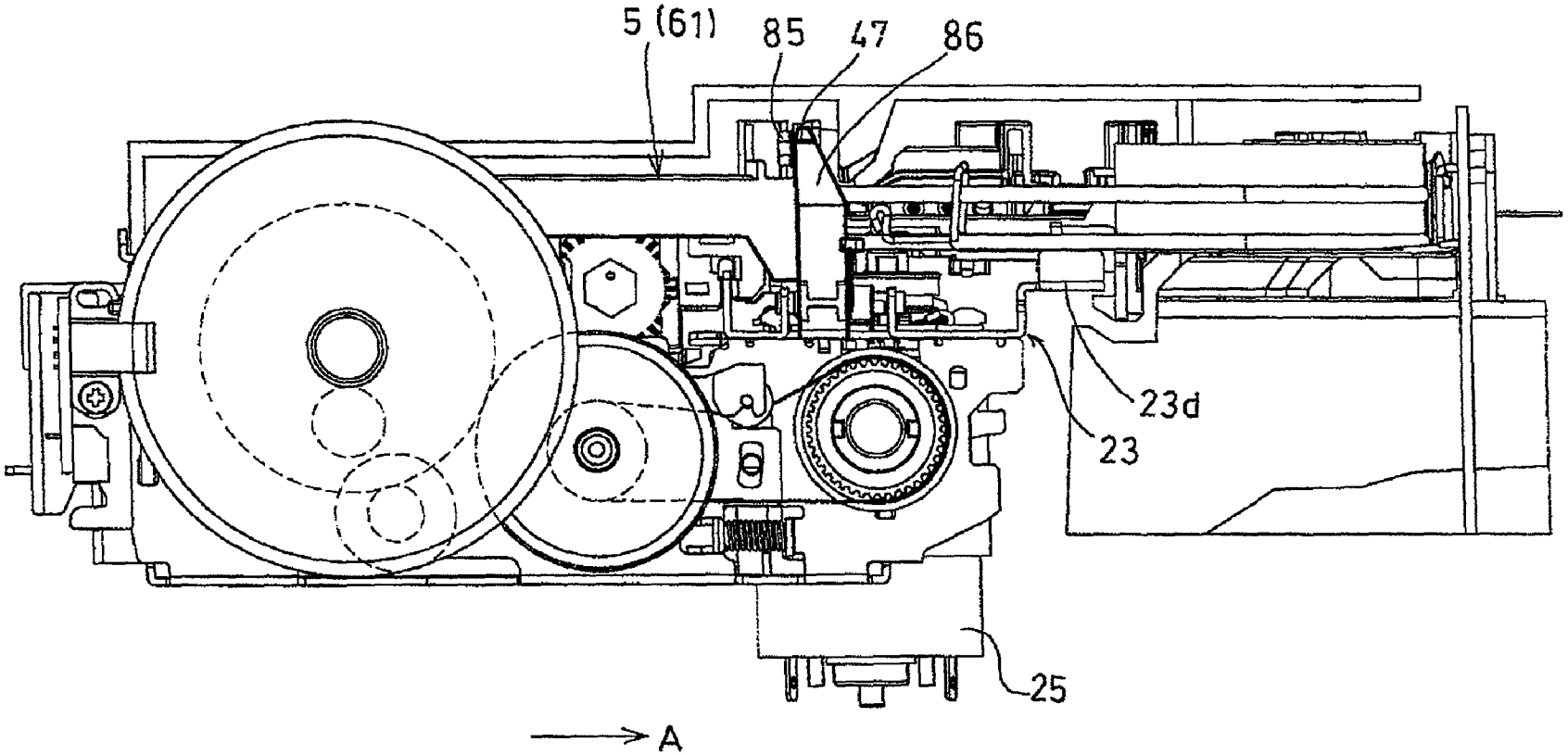
FIG. 8 is an enlarged cross-sectional view of the recording unit taken along a line VIII-VIII in FIG. 4.

A guide groove 85 that is open on the top and on the sides in the X-axis direction is formed in the upper surface of the top cover 66. The encoder strip 47 passes through the guide groove 85 in the X-axis direction. An optical transmitting sensor (photocoupler) 61*c* is disposed in the middle of the guide groove 85 so as to hold the front and back surfaces of the encoder strip 47 and allow the encoder strip 47 to pass therethrough. The photocoupler 61*c* is a sensor for letting the encoder strip 47 pass therethrough to detect the location and moving speed. The encoder strip 47 stretches between supporting pieces 86 (FIGS. 6 and 8) raised up from the right and left ends of the second guide member 23.

As shown in FIG. 10, an engaging depression 70 for engaging the protrusion 22*b* is formed in the lower surface of the rear portion of the holder 61.

As shown in FIGS. 11 and 12, a first sliding protrusion 55*a* is provided on the rear portion of the holder 61 and at the center in the X-axis direction so as to protrude downwardly from the lower surface of the holder 61. The first sliding protrusion 55*a* contacts the first sliding surface 51 of the first guide member 22.

A pair of left and right second sliding protrusions 55*b* is provided on the front portion of the holder 61, symmetrically about a center line OX of the holder 61 in the X-axis direction so as to protrude downwardly from the lower surface of the holder 61. Each of the left and right second sliding protrusions 55*b* is spaced away from the center line OX by a distance X1. The second sliding protrusions 55*b* contact the second sliding surface 52 of the second guide member 23. Thus, the first sliding protrusion 55*a* and the right and left second sliding protrusions 55*b* are arranged in an isosceles triangle on the carriage 5 when viewed from the top. With this configuration, the carriage 5 is stably supported by the first and second guide members 22 and 23.

Figure 9:
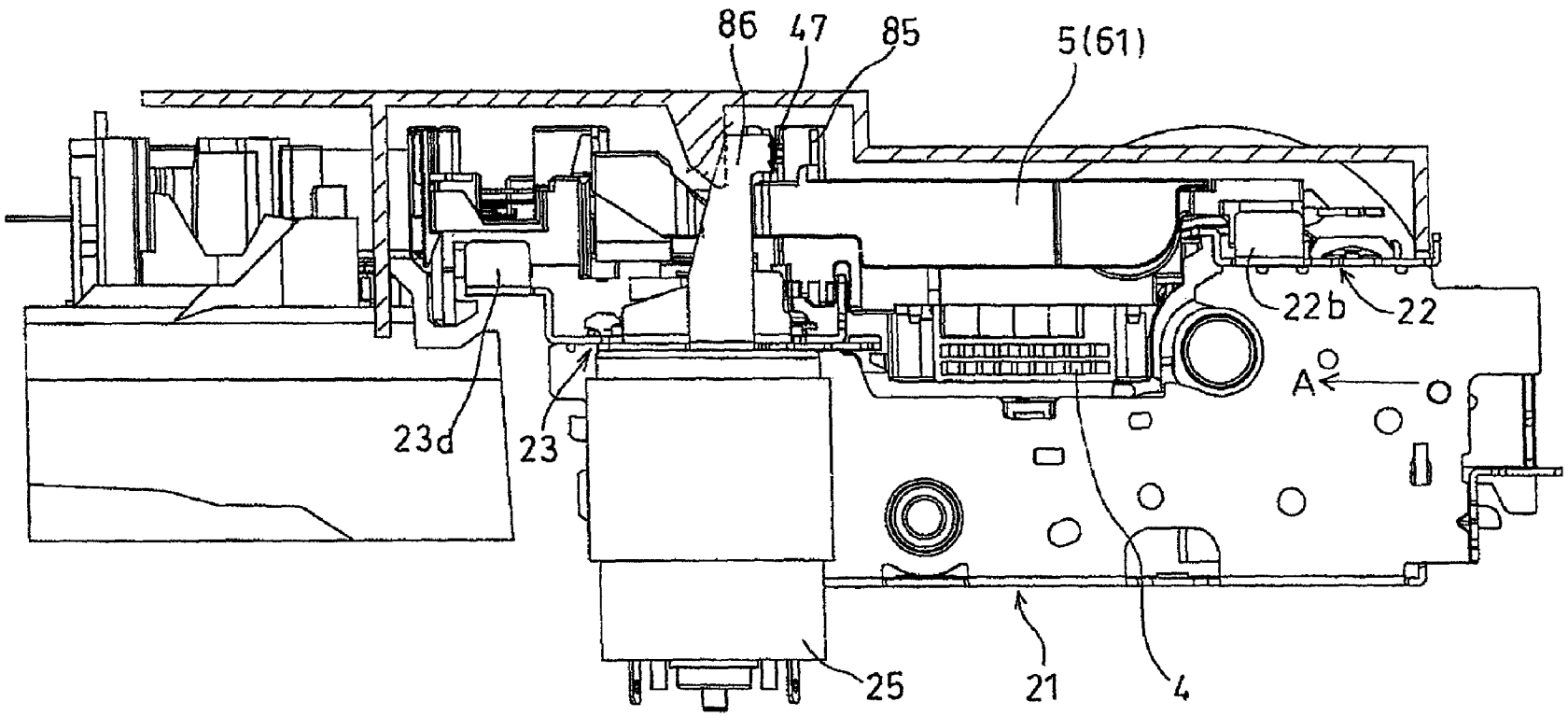
FIG. 9 is an enlarged cross-sectional view of the recording unit taken along a line IX-IX in FIG. 4.

A first auxiliary sliding protrusion 56*a* is provided adjacent to the first sliding protrusion 55*a*. The first auxiliary sliding protrusion 56*a* is configured so as to selectively protrude downward beyond the lower surface of the first sliding protrusion 55*a* and to contact the first sliding surface 51 when the paper gap between the nozzle surface 4*a* of the recording head 4 and the platen 26 is to be made larger than when the first sliding protrusion 55*a* contacts the first sliding surface 51. Similarly, second auxiliary sliding protrusions 56*b* are provided adjacent to the second sliding protrusions 55*b*. The second auxiliary sliding protrusions 56*b* are configured so as to selectively protrude downward beyond the lower surfaces of the second sliding protrusions 55*b* when the paper gap is to be made larger. The carriage 5 is provided with a mechanism (not shown) for selectively raising or lowering the first and second auxiliary sliding protrusions 56*a* and 56*b*, and also with application pieces 57*a* and 57*b* (FIG. 13) thereof. Detailed description of the mechanism will be omitted. The application pieces 57*a* and 57*b* can reciprocate to protrude or retract in the X-axis direction. By moving the carriage 5 in the X-axis direction, the application pieces 57*a* and 57*b* hit against cut-and-raised pieces 22*b* and 23*d* (FIGS. 5 and 9) of the first guide member 22 and the second guide member 23, respectively, thereby selectively raising or lowering the first and second auxiliary sliding protrusions 56*a* and 56*b*.

Figure 13:
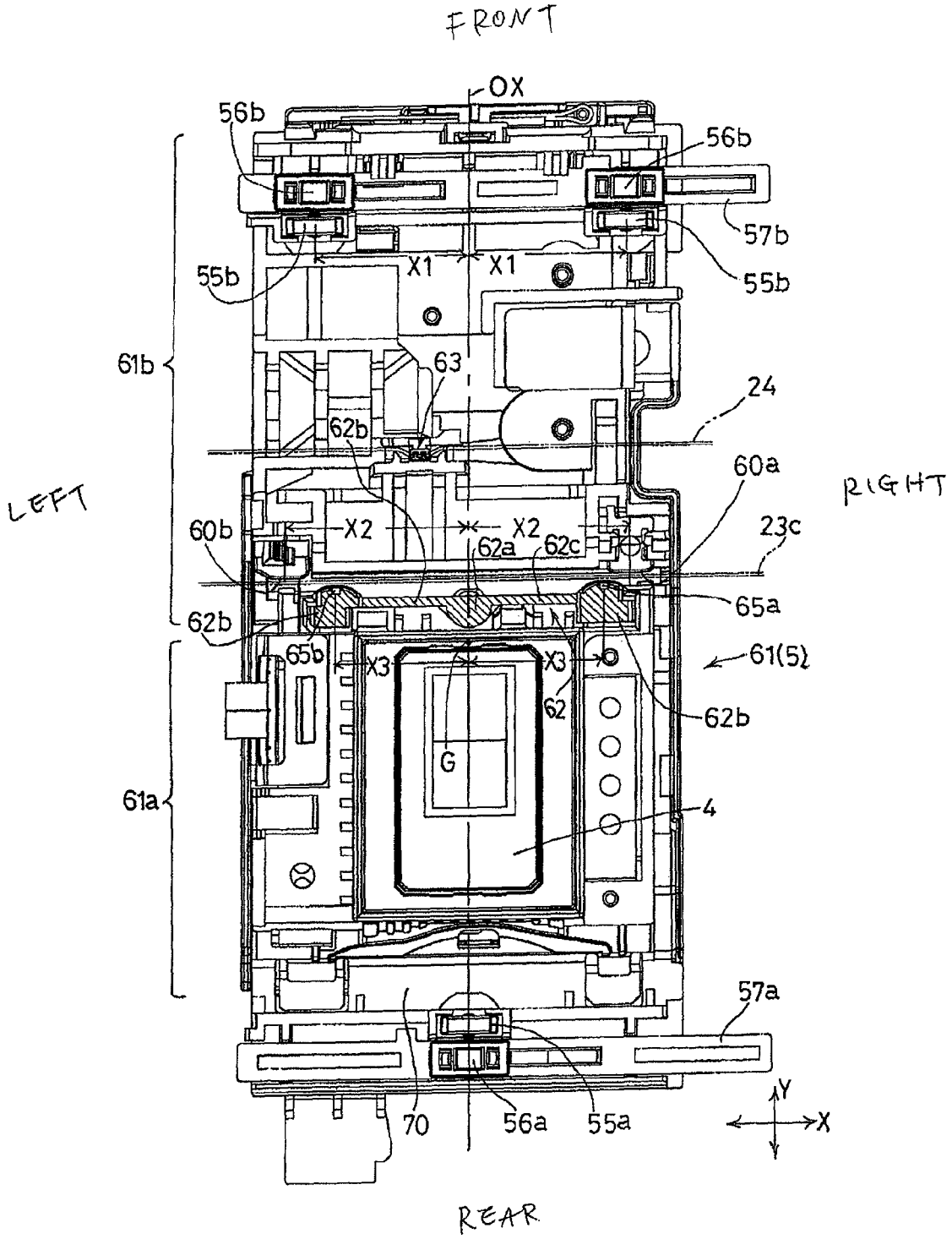
FIG. 13 is a bottom view of the carriage.

As shown in FIGS. 10 and 13, the holder 61 is integrally formed with a pair of left and right third sliding protrusions 60*a* and 60*b*. The left and right third sliding protrusions 60*a* and 60*b* are provided symmetrically about the center line OX with each spaced away from the center line OX by a distance X2. The third sliding protrusions 60*a* and 60*b* contact the third sliding surface 54 of the second guide member 23.

As shown in FIG. 13, a nip member 62 (a shaded part in FIG. 13) is provided to the holder 61 on the rear side of the guide piece 23*c*. The nip member 62 is made of synthetic resin to extend in the X-axis direction. A pair of left and light fourth sliding projections 65*a* and 65*b* is disposed at both ends of the nip member 62. The fourth sliding projections 65*a* and 65*b* are located symmetrically about the center line OX, with each spaced away from the center line OX by a distance X3 (<X2).

The nip member 62 has an attaching part 62*a*, which is attached to the holder 61, at the center in the X-axis direction, right and left expanding parts 62*b* at the both ends in the X-axis direction, and a connecting part 62*c* having a small cross section and connecting the attaching part 62*a* to the expanding parts 62*b*. The connecting part 62*c* itself has flexibility. Each expanding part 62*b* has a compression coil spring (not shown) therein. Due to an urging force of the compression coil springs, the nip member 62 (the fourth sliding projections 65*a* and 65*b*) and the third sliding protrusions 60*a* and 60*b* pinch the guide piece 23*c* therebetween, thereby elastically support the same. As shown in FIGS. 11 and 13, a space between the nip member 62 and the third sliding protrusions 60*a* and 60*b* is open in the main scanning direction X and also on the bottom.

As shown in FIGS. 10 and 13, a belt coupling part 63 is provided on the lower surface of the holder 61, at a position between the second sliding protrusions 55*b* and the third sliding protrusions 60*a* (60*b*) in the Y-axis direction. The belt coupling part 63 is coupled to a part of the timing belt 24. More specifically, the belt coupling part 63 is provided on the lower surface of the connection supporting part 61*b*, and is formed with a groove that is open on the bottom side and both sides in the main scanning direction X. The timing belt 24 is fitted into the groove.

As shown in FIG. 3, the driving pulley 89 and the driven pulley 90 on which the timing belt 24 is wound are arranged at both ends in the main scanning direction X on the upper surface of the horizontal wide piece 23*a* of the second guide member 23. With this arrangement, the second guide member 23 performs both a function of supporting sliding motion of the carriage 5 and a function of attachment of moving means, such as the driving pulley 89, the CR motor 25, and the driven pulley 90. Accordingly, there are realized effects of saving cost and miniaturization of the recording unit 7, and consequently the image forming device 1.

Figure 14:
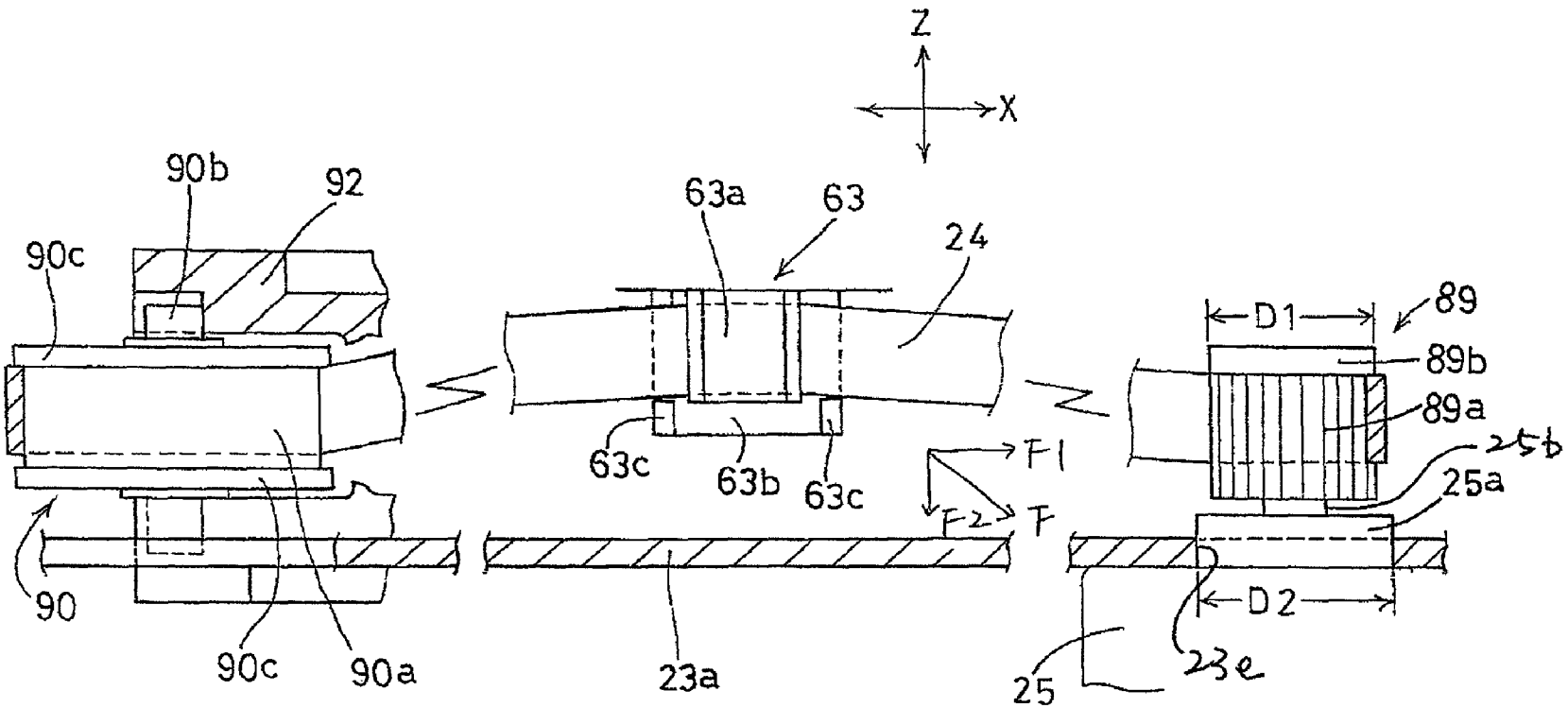
FIG. 14 is an explanatory view showing a coupling state of a timing belt.
Figure 15:
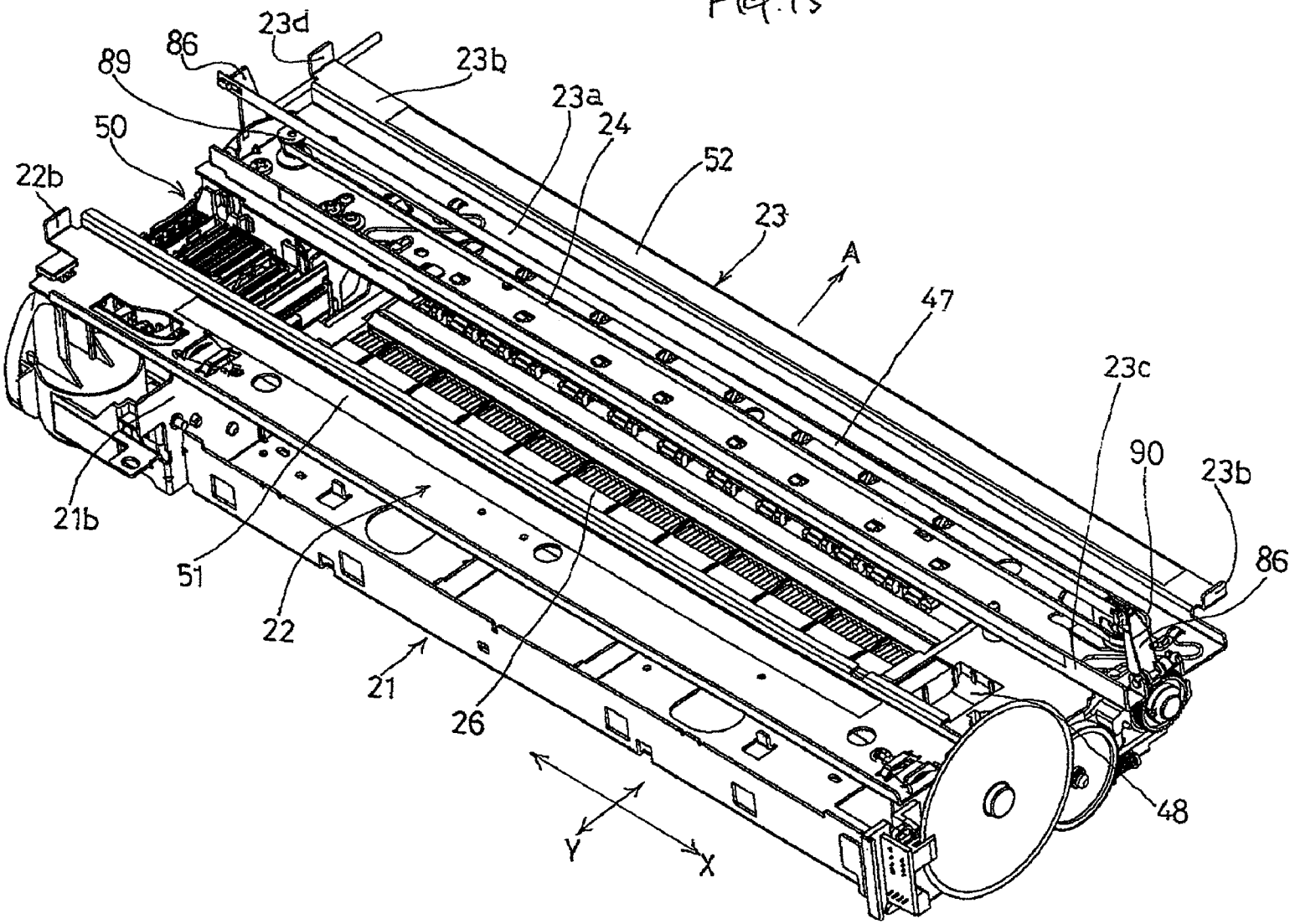
FIG. 15 is a perspective view of the recording unit with the carriage being removed.

As shown in FIG. 14, the driving pulley 89 is engaged with a driving shaft 25*b* protruding from a neck part 25*a* of the carriage motor 25. A maximum diameter D1 of the driving pulley 89 is smaller than a diameter D2 of the neck part 25*a*. An attachment opening 23*e* with a diameter that is equal to the diameter D2 of the neck part 25*a* is formed through the horizontal wide piece 23*a* of the second guide member 23. The driving motor 25 is fixed to the horizontal wide piece 23*a* as follows. That is, the neck part 25*a* and the driving pulley 89 attached to the driving shaft 25*b* are inserted into the attachment opening 23*e* from below, and then, the driving motor 25 is fixed to the horizontal wide piece 23*a* from above with a screw (not shown).

Thus, the driving pulley 89 can be bought into engagement with the driving shaft 25*b* before the driving motor 25 is attached to the second guide member 23. Also, mechanical strength of the second guide member 23 is not weakened so much since it is only necessary to form the attachment opening 23*e* for the attachment of the driving motor 25 in the horizontal wide piece 23*a* of the second guide member 23. Furthermore, the driving pulley 89 can be positioned closer to the neck part 25*a* in comparison with the attachment structure in which the horizontal wide piece 23*a* is disposed between the neck part 25*a* and the driving pulley 89.

A tooth surface (tooth mold) 89*a* for the timing belt 24 is formed on the circumference of the driving pulley 89. This prevents slip phenomenon caused between the rotation of the driving motor 25 and the movement of the timing belt 24. A flange part 89*b* for preventing detachment of the timing belt 24 is integrally formed on the upper edge of the driving pulley 89.

The driven pulley 90 includes a pulley part 90*a* on which the timing belt 24 is wound, a shaft part 90*b* protruding upward and downward from the pulley part 90*a* along the rotational axis of the pulley part 90*a*, and large-diameter flange parts 90*c* for preventing both edges of the timing belt 24 in the width direction thereof from detaching from the pulley part 90*a* in the upward or downward direction. The pulley part 90*a*, the shaft part 90*b*, and the large diameter flange parts 90*c* are all formed integrally with one another from a synthetic resin material. The driven pulley 90 is rotatably supported by a holder 92, which is elastically urged in the direction of separating from the driving pulley 89 by a spring (not shown).

As shown in FIG. 3, the driven pulley 90 is formed to have a larger diameter than the driving pulley 89. As shown in FIGS. 3 and 4, the driven pulley 90 and the driving pulley 89 are disposed such that the minimum distance between the axis (rotational center) of the driving pulley 89 and the guide piece 23*c* is shorter than the minimum distance between the axis (rotational center) of the driven pulley 90 and the guide piece 23*c*, so that a rear side 24*a* of the timing belt 24, at which the timing belt 24 is fixedly coupled to the carriage 5, extends parallel to the guide piece 23*c*. With this configuration, the carriage 5 can be stably moved along the third sliding surface 54 of the guide piece 23*c* (FIG. 11), thereby improving image recording performance. By disposing the large-diameter driven pulley 90 to a position separate from the guide piece 23*c*, the width of the second guide member 23 in the sheet feeding direction A can be reduced.

Further, the driving pulley 89, the driven pulley 90, and the belt coupling part 63 of the carriage 5 that is coupled to the timing belt 24 are arranged so that component forces of the tensile force exerted on the rear side 24*a* of the timing belt 24 press the carriage 5 against both the second sliding surface 52 and the third sliding surface 54 of the second guide member 23. With this configuration, the movement of the carriage 5 can be stable.

Specifically, the minimum distance between the belt coupling part 63 and the third sliding surface 54 is set larger than the minimum distances between the third sliding surface 54 and wound parts of the timing belt 24 that are wound on the driving pulley 89 and the driven pulley 90. Thus, due to a component force in the Y-axis direction of the tensile force, the carriage 5 is pressed against the third sliding surface 54. As a result, the orientation of the carriage 5 during movement is stabilized, thereby improving image recording performance.

As shown in FIG. 14, the position of the belt coupling part 63 is set higher than that of the wound parts of the timing belt 24. The belt coupling part 63 has blocks 63*a* and 63*b* and a pair of engaging claws 63*c* protruding from both sides of the lower end of the block 63*b*. The timing belt 24 is pinched between the blocks 63*a* and 63*b*, and the lower edge of the timing belt 24 is engaged with the engaging claws 63*c* so as not to drop off downward. The upper edge of the timing belt 24 is controlled by the flange part 89*b* of the driving pulley 89 as well as the upper flange part 90*c* of the driven pulley 90 so as not to go off upward.

As shown in FIG. 13, the center of gravity G of the whole carriage 5 is located on the center line OX in the X-axis direction and on the side of the storage part 61*a* of the carriage 5 in the Y-axis direction. As shown in FIG. 10, the center of gravity G is located away from the fourth sliding protrusions 65*a* and 65*b* by a distance Y1 in the Y-axis direction. The height of the center of gravity G in the whole carriage 5 falls within the width of the belt coupling part 63 in the height direction Z.

As shown in FIG. 14, the tensile force F exerted on the timing belt 24 at the belt coupling part 63 has a component force F1 in the X-axis direction and a downward component force F2 in the Z-axis direction. The component force F2 and the weight of the carriage 5 act upon the first sliding surface 51 of the first guide member 22 and the second sliding surface 52 of the second guide member 23 in the Z-axis (vertical) downward direction via the first sliding protrusion 55*a* and the second sliding protrusions 55*b* shown in FIG. 10.

As shown in FIG. 10, since a distance Y2 between the center of gravity G of the carriage 5 and the first sliding protrusion 55*a* in the Y-axis direction and a distance Y3 between the center of gravity G and the second sliding protrusions 55*b* in the Y-axis direction are large, the carriage 5 is stably supported by the first and second guide members 22 and 23 via the first sliding protrusion 55*a* and the pair of second sliding protrusions 55*b*, while the carriage 5 remains stationary or moves in the main scanning direction X at a constant speed. Thus, the gap (paper gap) between the lower surface of the recording head 4 mounted in the carriage 5 and the sheet P on the platen 26 is stabilized, thereby improving image recording performance.

Furthermore, since the position of the belt coupling part 63 is set higher than that of the wound parts of the timing belt 24 (the driving pulley 89 and the driven pulley 90), especially when the carriage 5 starts moving in the main scanning direction X (when the carriage 5 moves with increasing speed from the stationary state), the carriage 5 is subjected to the vertical component force F2 of the tensile force F exerted on the timing belt 24 at the position of the belt coupling part 63. In this case, the first sliding protrusion 55*a* (first sliding surface 51) and the second sliding protrusions 55*b* (second sliding surface 52) can effectively receive a rotation moment of the carriage 5 around the center of gravity G due to the downward component force F2, since the belt coupling part 63 is located between the first sliding protrusion 55*a* (first sliding surface 51) and the second sliding protrusions 55*b* (second sliding surface 52) in the Y-axis direction. As a result, the carriage 5 does not rotate around an X axis passing through the center of gravity G and can be stably moved in the main scanning direction X.

Figure 5:
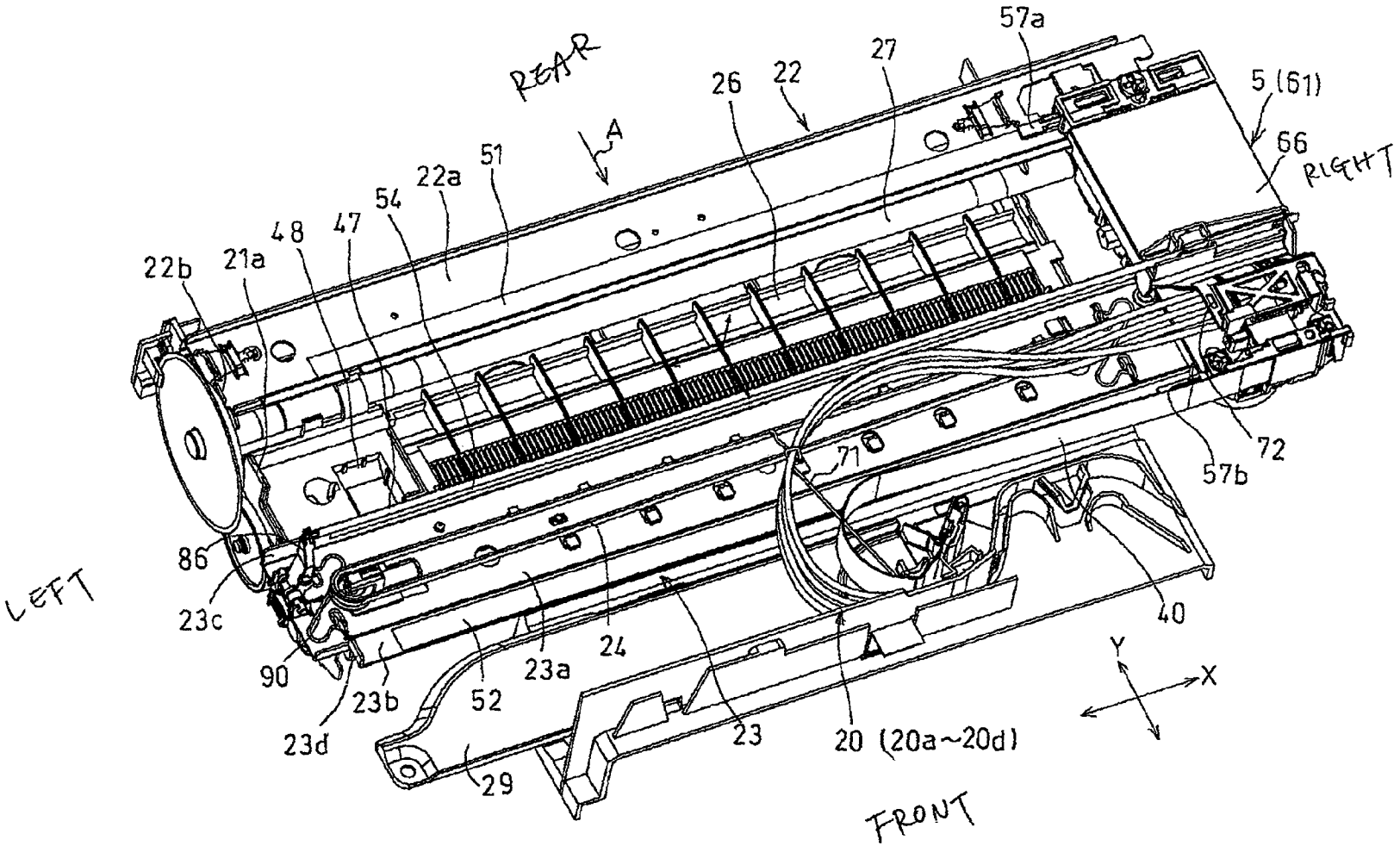
FIG. 5 is a perspective view of the recording unit in FIG. 2.

As described above, the ink supply tubes 20*a* to 20*d* are connected to the tube connecting unit 72 (FIG. 5). As shown in FIG. 11, the tube connecting unit 72 is located between the first sliding protrusion 55*a* and the second sliding protrusions 55*b* in the Y-axis direction. Thus, a load in the vertical direction Z is applied to the connection supporting part 61*b*, and the second sliding protrusions 55*b* (second sliding surface 52) can receive a moment of the carriage 5 around the X-axis passing through the center of gravity G due to the load. Thus, the carriage 5 does not rotate around the X-axis passing through the center of gravity G and can be stably moved in the main scanning direction X.

The tube connecting unit 72 is located between the second sliding protrusions 55*b* and the third sliding protrusions 60*a* and 60*b* in the Y-axis direction. The second sliding protrusions 55*b* (second sliding surface 52) can also receive a moment of the carriage 5 around the X-axis passing through the center of gravity G due to a load applied when the ink supply tubes 20*a* to 20*d* are connected to the tube connecting unit 72. As a result, the carriage 5 does not rotate around the X-axis and can be stably moved in the main scanning direction X.

As shown in FIGS. 4, 12 and 13, the carriage 5 is supported on the first sliding surface 51 and the second sliding surface 52 by the first sliding protrusion 55*a* and the pair of right and left second sliding protrusions 55*a* and 55*b* arranged in a triangle when viewed from the top, as described above. Also, the distance X1 in the X-axis direction between the center of gravity and each of right and left second sliding protrusions 55*a* and 55*b* is set large. Thus, the posture of the carriage 5 with respect to a direction around a Y-axis passing through the center of gravity G of the carriage 5 becomes stable. The right and left second sliding protrusions 55*a* and 55*b* and the second sliding surface 52 can receive a rotation force of the carriage 5 around a Y-axis passing through the belt coupling part 63 due to the component force F1 of the tensile force F exerted on the timing belt 24, especially when the carriage 5 starts moving in the main scanning direction X. As a result, the carriage 5 does not rotate around the Y-axis and can be stably moved in the main scanning direction X.

Moreover, as shown in FIG. 13, each of the right and left third sliding protrusions 60*a* and 60*b* of the carriage 5 is separated from the center line OX of the carriage 5 in the X-axis direction by the large distance X2 and contacts the third sliding surface 54 extending in the vertical direction. Also, the fourth sliding projections 65*a* and 65*b* are disposed symmetrically about the center line OX of the carriage 5 and elastically press the guide piece 23*c* from the rear side. Thus, when the carriage 5 starts moving in the main scanning direction X, the left and right third sliding protrusions 60*a* and 60*b*, the fourth sliding projections 65*a* and 65*b*, and the third sliding surface 54 can effectively receive the rotation force of the carriage 5 around a Z-axis passing through the center of gravity G due to the component force F1 exerted on the timing belt 24 in the X-axis direction. As a result, the carriage 5 does not rotate around the Z-axis and can be stably moved in the main scanning direction X.

Next, the arrangement of the elastic ink supply tubes 20 will be described in detail. The ink supply tubes 20*a* to 20*d* couple the respective ink cartridges 19 to the recording head 4 at all time and are mutually-independent tube members.

As shown in FIG. 5, base portions of the ink supply tubes 20*a* to 20*d* are arranged in a vertical line on the upper surface of the bottom cover 29 and extend to the left in the X-axis direction.

Intermediate portions of the ink supply tubes 20*a* to 20*d* run over the upper surface of the second guide member 23 from the bottom cover 29 and are bundled by a wire-like movable bundle member 71. All of the ink supply tubes 20*a* to 20*d* are curved and twisted at the intermediate portions. While being arranged in a substantially horizontal line, tip ends of all the ink supply tubes 20*a* to 20*d* are connected to the tube connecting unit 72.

A command signal for causing the nozzles of the recording head 4 to selectively eject ink droplets is transmitted from a control unit (not shown) provided in the housing 2 by way of the flexible flat cable 40. The flexible flat cable 40 is disposed in an area where the ink supply tubes 20*a* to 20*d* pass when the carriage 5 reciprocates in the main scanning direction X, substantially in parallel to the direction in which the ink supply tubes 20 extend, such that the broad plane of the flexible flat cable 40 is vertically oriented. The curved portion of the flexible flat cable 40 is located inner of the curved portions of the ink supply tubes 20*a* to 20*d* in the radial direction.

Since the ink supply tubes 20*a* to 20*d* have the above-mentioned curved portions, the tube connecting unit 72 and in turn, the carriage 5 are subjected to a rotation moment around the Z-axis, due to restoring forces of the ink supply tubes 20*a* to 20*d*. However, the rotation force can be effectively received by the pair of right and left third sliding protrusions 60*a* and 60*b*, the pair of fourth sliding projections 65*a* and 65*b*, and the third sliding surface 54.

While the invention has been described in detail with reference to the thereof, it would be apparent to those skilled in the art that various changes and modifications may be made therein without departing from the spirit of the invention.

What is claimed is:

1. An image forming device comprising:

a recording head having a nozzle surface;

a carriage that mounts the recording head and is reciprocatable in a first direction;

a first guide member having a first sliding surface extending in a horizontal direction;

a second guide member having a second sliding surface extending in the horizontal direction, the second guide member being disposed on a downstream side of the first guide member with respect to a second direction orthogonal to the first direction; and an endless belt that extends in the first direction above the second guide member and is movable in the first direction, wherein:

the first sliding surface and the second sliding surface slidably support the carriage and extend parallel to the nozzle surface;

the carriage is provided with a first protruding member that contacts the first sliding surface and a second protruding member that contacts the second sliding surface;

both the first protruding member and the second protruding member protrude downward from a bottom side of the carriage;

the carriage and the endless belt are coupled to each other at a coupling point located between the first protruding member and the second protruding member with respect to the second direction;

the second guide member has a third sliding surface extending upward in a direction substantially orthogonal to the second sliding surface, the third sliding surface being located between the first sliding surface and the second sliding surface with respect to the second direction; and the carriage includes a third protruding member that slidably contacts the third sliding surface, a fourth protruding member disposed on an opposite side of the third sliding surface from the third protruding member, and an elastic member that elastically urges the fourth protruding member toward the third sliding surface; and the coupling point between the carriage and the endless belt is located between the second protruding member and the third protruding member with respect to the second direction.

2. The image forming device according to claim 1, wherein:

the coupling point between the carriage and the endless belt is located higher than an attachment part of the endless belt that is attached to the second guide member, with respect to a vertical direction perpendicular to both the first direction and the second direction.

3. The image forming device according to claim 2, wherein the second protruding member includes a pair of protrusions, and the first protruding member and the pair of protrusions of the second protruding member are arranged in a triangle.

4. The image forming device according to claim 1, further comprising:

a housing;

an ink storage member that contains ink, the ink storage member being disposed stationary within the housing; and a bendable ink supply tube that supplies the ink from the ink storage member to the recording head, the ink supply tube being connected to one side of the carriage in the first direction, wherein:

the ink supply tube is connected to the one side of the carriage at a location between the first protruding member and the second protruding member in the second direction.

5. The image forming device according to claim 4, wherein the second protruding member includes a pair of protrusions, and the first protruding member and the pair of protrusions of the second protruding member are arranged in a triangle.

6. The image forming device according to claim 1, wherein the second protruding member includes a pair of protrusions, and the first protruding member and the pair of protrusions of the second protruding member are arranged in a triangle.

7. An image forming device comprising:

a recording head having a nozzle surface;

a carriage that mounts the recording head and is reciprocatable in a first direction;

a first guide member having a first sliding surface extending in a horizontal direction;

a second guide member having a second sliding surface extending in the horizontal direction, the second guide member being disposed on a downstream side of the first guide member with respect to a second direction orthogonal to the first direction; and an endless belt that extends in the first direction above the second guide member and is movable in the first direction;

a housing;

an ink storage member that contains ink, the ink storage member being disposed stationary within the housing; and a bendable ink supply tube that supplies the ink from the ink storage member to the recording head, the ink supply tube being connected to one side of the carriage in the first direction, wherein:

the first sliding surface and the second sliding surface slidably support the carriage and extend parallel to the nozzle surface;

the carriage is provided with a first protruding member that contacts the first sliding surface and a second protruding member that contacts the second sliding surface;

both the first protruding member and the second protruding member protrude downward from a bottom side of the carriage;

the carriage and the endless belt are coupled to each other at a coupling point located between the first protruding member and the second protruding member with respect to the second direction;

the ink supply tube is connected to the one side of the carriage at a location between the first protruding member and the second protruding member in the second direction, the second guide member has a third sliding surface;

the carriage comprises a third protruding member that slidably contacts the third sliding surface; and the ink supply tube is connected to the one side of the carriage at the location between the second protruding member and the third protruding member in the second direction.

8. The image forming device according to claim 7, wherein the second protruding member includes a pair of protrusions, and the first protruding member and the pair of protrusions of the second protruding member are arranged in a triangle.

* * * * *